US005312529A

United States Patent [19]

Antonelli et al.

[11] Patent Number: 5,312,529

[45] Date of Patent: * May 17, 1994

[54] METHOD OF COATING METAL USING LOW TEMPERATURE PLASMA AND ELECTRODEPOSITION

[75] Inventors: Joseph A. Antonelli, Riverton, N.J.; Tyau-Jeen Lin, Chadds Ford, Pa.; Duck J. Yang, Wilmington, Del.; Hirotsugu Yasuda, Columbia, Mo.

[73] Assignee: E. I. Du Pont de Nemours and Company, Wilmington, Del.

[ * ] Notice: The portion of the term of this patent subsequent to Dec. 25, 2007 has been disclaimed.

[21] Appl. No.: 968,512

[22] Filed: Oct. 29, 1992

Related U.S. Application Data

[63] Continuation-in-part of Ser. No. 789,485, Nov. 12, 1991, Pat. No. 5,182,000.

[51] Int. Cl.[5] ..... C25D 13/12

[52] U.S. Cl. ..... 204/181.1; 204/181.7; 427/488; 427/535

[58] Field of Search ..... 204/181.1, 181.7; 427/488, 535

[56] References Cited

U.S. PATENT DOCUMENTS 4,980,196 12/1990 Yasuda et al. ..... 427/539
5,182,000 1/1993 Antonelli et al. ..... 204/181.1

*Primary Examiner*—John Niebling
*Assistant Examiner*—Kishor Mayekar
*Attorney, Agent, or Firm*—Chris P. Konkol

[57] ABSTRACT

This invention relates to the use of low temperature plasma technology for significantly improved corrosion protection of metals. The plasma process involves pretreatment of the surface of the metal with a gas plasma to remove oxygen, followed by plasma deposition of a thin polymeric film on the treated surface, followed by cathodic electrocoat application of a primer.

9 Claims, 2 Drawing Sheets

METHOD OF COATING METAL USING LOW TEMPERATURE PLASMA AND ELECTRODEPOSITION

CROSS REFERENCE TO RELATED APPLICATION

This application is a continuation-in-part application of application Ser. No. 07/789,485 filed Nov. 12, 1991 now U.S. Pat. No. 5,182,000.

FIELD OF THE INVENTION

This invention relates to the use of low temperature plasma technology for the corrosion protection of metals. Our novel process involves pretreatment of the metal with a plasma gas, followed by plasma deposition of a thin polymer film, and finally application of a cathodic electrocoat primer. In particular, the pretreatment step removes oxygen from the surface of the metal.

Background

The corrosion protection of steel substrates is important for many industries, including the automotive and steel industries. Currently the most common methods of corrosion protection of steel substrates are galvanizing, application of zinc phosphate, application of primer materials by electrodeposition, conventional spray or dip priming, oil coating and combinations thereof. However, especially in the automotive industry, these methods are associated with pollution in the form of volatile organic compounds (VOC), (2) excessive waste disposal, (3) inadequate coverage of recessed areas, and (5) inadequate retention or performance of corrosion protection.

It is generally known that plasma deposition of thin films gives a very dense layer of film, with uniform deposition, no "pin holes", and good edge coverage. Furthermore, such a process does not require solvents, so there is no VOC problem. However, most of the work in the plasma deposition area has been restricted to small objects (e.g., microelectronic components). Plasma processing for larger objects has been used primarily for plastic substrates.

The plasma deposition of organic films on metal is generally described in an article entitled "Surface Coating of Metals in a Glow Discharge" in the Journal of the Oil and Colour Chemists Association, Vol. 48, 1965 (hereinafter, the "Glow Discharge" article). This article describes, in general terms, a method of coating a steel substrate with thin polymer films derived from organic vapors (styrene, acrylates, butadiene, diethyl silicate, and tetraethyl orthosilicate) using glow discharge (i.e., plasma deposition) for short term protection of the steel substrate.

The plasma deposition of organosilanes and other thin films for corrosion protection of steel in the automotive industry is disclosed in U.S. Pat. No. 4,980,196. In the processes disclosed therein, multi-layered coatings are formed, including the combination of a thin film, by means of plasma deposition, with a primer coating. In Example 5 of the patent, an electrocoat primer was employed. However, in order to be competitive with present processes, there is a need for even better adhesion and/or corrosion protection.

What is needed is an improved method of providing corrosion resistance, particularly of metal substrates involved in automobile production. Such an improved method must result in a coating having good adhesion, good edge coverage, and good barrier properties. It would be especially desirable to be able to obtain improved corrosion protection of metal that has not been galvanized, which corrosion protection is comparable to, or better than, existing processes involving galvanized metals. For example, a method which uses bare or cold rolled steel instead of galvanized steel would be advantageous, not only because the metal substrate is less expensive and easier to manufacture, to begin with, but because material recycling of parts or, eventually, a used automobile is significantly more expensive if the metal has been galvanized.

SUMMARY OF THE INVENTION

It has been discovered that improved corrosion resistance of steel or other metals can be realized by: (1) plasma pretreatment of the metal to remove oxygen and prevent further oxidation from occurring; (2) plasma deposition of a thin polymeric film; and (3) cathodic electrodeposition of an organic primer coating. Plasma treatment to remove oxygen (including oxygen in the form of oxides) may be accomplished employing a noble gas, hydrogen, nitrogen, or a mixture thereof. In particular, it was found that adhesion of the subsequent coatings was significantly improved by plasma pretreatment of the metal surface with a gas comprising hydrogen, argon, neon, helium, xenon, krypton, nitrogen, or mixtures thereof. A mixture of argon and hydrogen has been proven to be especially effective.

DETAILED DESCRIPTION OF THE INVENTION

Figure 1:
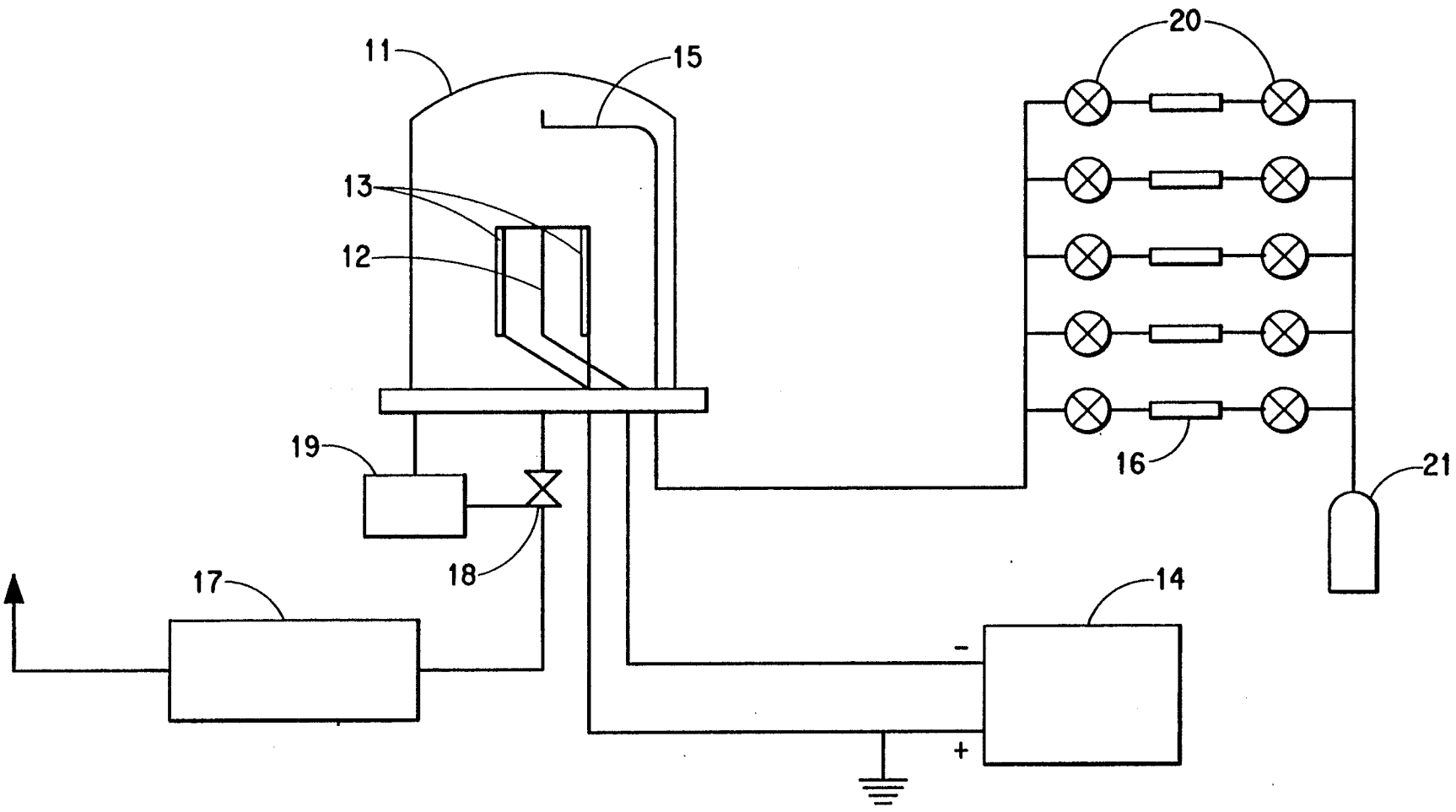
FIG. 1 is a schematic diagram of one embodiment of a plasma deposition system for carrying out the present process.

It has been found that a simple coating system which involves an oxygen-removing plasma pretreatment, plasma deposition, and electrocoat application is an effective way of protecting a metal surface, either ungalvanized or galvanized, from corrosion. Our novel system is usable with bare steel, cold rolled steel, stainless steel, galvanized steel, aluminum, copper, and brass. Our system is also applicable to metal substrates of different sizes and shapes, including stamped or unstamped metal. Suitable metal substrates are preassembled autobodies, autobody parts, rolls, coils, sheets, and so forth. However, the corrosion protection of ungalvanized cold-rolled or bare steel is the most advantageous and important use of the present invention at this time. In fact, the corrosion protection obtained by the present invention with ungalvanized steel is surprisingly as good or better than with galvanized steel. Moreover, superior edge protection is obtained.

Our novel system represents three basic steps. The first step is pretreatment of the steel substrate with a particular kind of plasma gas to remove oxygen (in the form of adsorbed oxygen or oxides) from the surface of the substrate. The second step is plasma deposition of a thin film. The third step is the application of an electrocoat primer over the plasma film. An optional fourth step is the addition of further coatings, including primer, monocoat and basecoat/clearcoat systems.

If the metal substrate to be coated is oiled or otherwise contaminated, as sometimes occurs when the material is received from a metal manufacturer, then it should preferably be cleaned prior to the above-mentioned plasma pretreatment. Cleaning may be readily accomplished by conventional methods, for example with solvents and/or detergents. Alternatively, plasma treatment with an oxidizing gas such as oxygen can be used to remove organic contaminants. Such a plasma treatment, for the purpose of cleaning, may be anodic or cathodic, employing AC or DC voltage.

The first step of the present invention involves plasma pretreatment of the surface of the metal substrate. This is necessary to achieve improved adhesion and/or corrosion protection. This pretreatment removes oxygen, including oxides, from the surface of the metal substrate to be coated and prevents further oxidation from occurring. The removal of oxygen, including oxides, from the metal substrate, to form a substantially oxygen-free or pristine surface is desired. However, although the metal substrate is thereby relatively oxygen depleted, residual oxygen/oxides on the metal substrate may be acceptable, depending on the substrate, circumstances, and the product properties desired. In any case, the process of this invention should succeed in removing a substantial portion of the oxygen. Before plasma treatment, the surface of the metal substrate is normally characterized by the presence of oxygen in the amount of over 50 percent in terms of atomic percent, as determined by ESCA, AES (Auger Electron Spectroscopy) or SNMS (Sputtered Neutral Mass Spectroscopy). Such oxygen may include oxides in the form of FeO, $Fe_2O_3$, $Fe_3O_4$, and so forth. Such oxygen may be non-homogenously distributed over the surface. After plasma treatment of the metal substrate for a sufficient period of time, a substantial amount of oxygen is removed, suitably leaving less than 30 atomic percent of oxygen, preferably less than 10 atomic percent, and most preferably less than 5 atomic percent of oxygen. Typically, less than 2 atomic percent oxygen may remain, including zero percent, as measured by surface analysis.

Applicants have found that pretreatment with a plasma comprising hydrogen, nitrogen, a noble gas such as helium, neon, argon, krypton, or xenon, or mixtures thereof is effective to remove oxygen and prevent oxidation. Such gases, alone, in mixture, or in series, during plasma pretreatment, activate the substrate surface and enable a passivating interfacial layer between the metal substrate and subsequent coatings to be formed during the plasma deposition step. For example, argon may be used in mixture with other inert gases such as helium, neon, xenon, or mixtures thereof. The preferred gas for plasma pretreatment is a gaseous mixture of hydrogen and argon, wherein the amount of hydrogen is 20 to 80 mole percent, and the amount of argon is 20 to 80 mole percent. It is believed that such a plasma treatment reduces and/or removes surface oxides, e.g., iron oxides. It is believed that argon knocks off oxides and hydrogen reduces them. A combination of argon and hydrogen may be somewhat faster that either one alone.

Such a plasma pretreatment has unexpectedly been found to be synergistically effective with subsequent application of an electrocoat, and the resulting multilayered coating exhibits excellent adhesion, solving the problem of lack of adhesion involving the combination of plasma deposition and an electrocoated primer.

After the plasma pretreatment step, the metal substrate is covered with a thin layer or layers of an organic polymer, by means of plasma deposition, in a highly evacuated chamber.

The subsequent application of a primer can be accomplished in a variety of ways. It is important to select a primer which has good adhesion to the plasma deposited film, good barrier properties and good corrosion protection.

As indicated above, the plasma pretreatment and plasma deposition steps can be applied to stamped or prestamped metal. However, subsequent electrodeposition is generally on the stamped metal substrate, a fabricated part or an entire autobody.

The steps of the present invention are described in greater detail below, in reference to the accompanying figures.

STEP 1: PLASMA PRETREATMENT

An overall diagram of an illustrative system for practicing the present invention is shown in FIG. 1. However, it will be understood by the skilled artisan that alternate systems could be designed to practice the invention. For example, it would also be possible for the plasma pretreatment and the plasma deposition to take place in separate chambers in a continuous process. Instead of direct current plasma gas treatment, alternate current (AC), audio frequency (AF), or radio frequency (RF) plasma would also be effective. The substrate may be cathodic or anodic. A preferred embodiment employs cathodic DC plasma pretreatment. However, an AC system may be less expensive to operate.

Figure 2A:
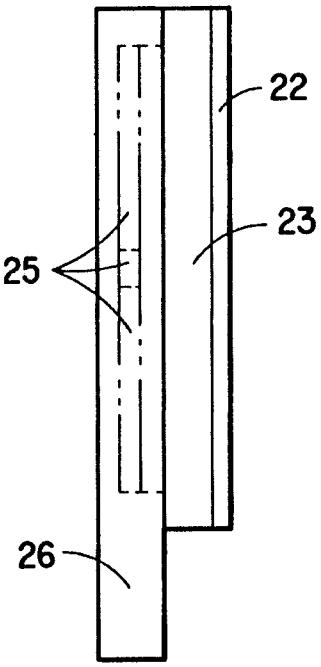
FIG. 2A is an enlarged side view of the anode in FIG. 2.
Figure 2:
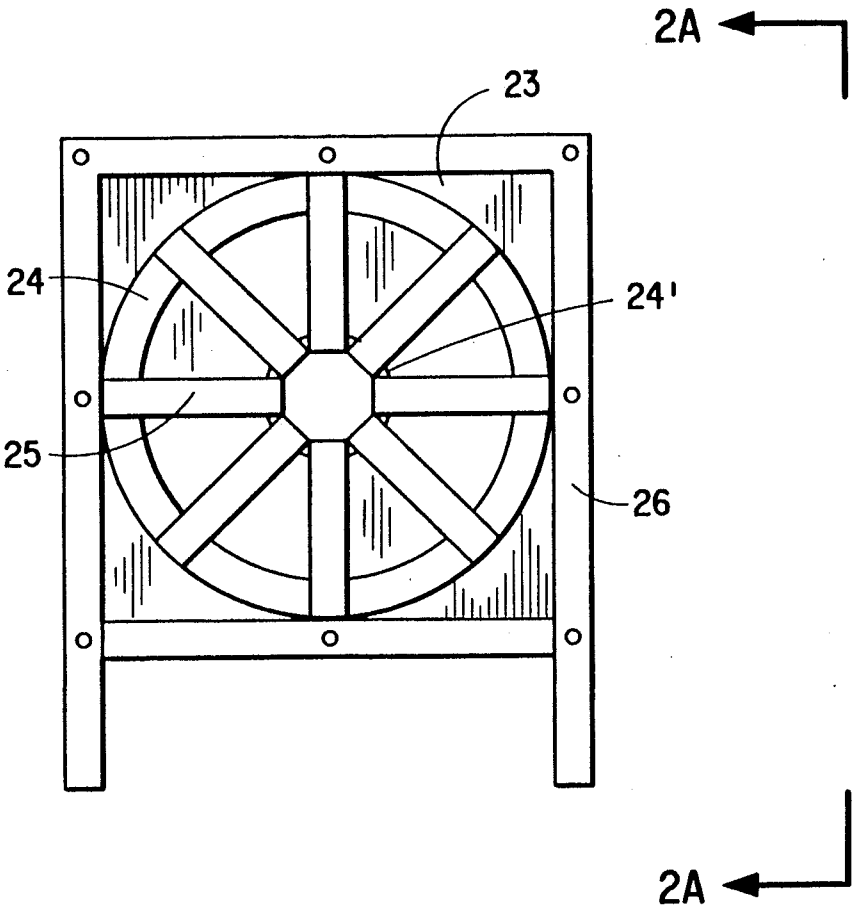
FIG. 2 is a frontal view of one of the anodes employed in the plasma deposition system of FIG. 1.

FIG. 1 shows a vacuum chamber 11, a cathode 12 (which is the steel substrate), two anodes 13, a power supply 14, a plasma gas feeding line 15, a plasma gas flow controller 16 and a vacuum pump 17. The negative pole of DC power supply 14 is connected to a steel substrate to form a cathode 12. The grounded positive pole of DC power supply 14 is connected to anodes 13. As shown in FIG. 2, anodes 13 are preferably equipped with a superimposed magnetic field (magnetron), although a magnetron is not necessary for forming a plasma. When the magnetron is used in the plasma deposition step, the magnetic field at the magnet surface should be between 10–10,000 Gauss, preferably 100–1000 Gauss and most preferably 700–900 Gauss. Magnetrons are well known in the art and are generally disclosed in Thin Film Processes, edited by Vossen and Kern, 1978, at Part II-2 and Part II-4. As will be apparent to those skilled in the art, there are numerous ways to superimpose a magnetic field.

FIG. 2 is a detail of the anode arrangement used in our examples. The anode 13 is composed of an aluminum plate 23, a titanium plate 22 (which is attached on inner side of aluminum plate 23), an iron ring 24, and a circular iron plate 24', (which are attached on the backside of the aluminum plate 23), and eight permanent magnetic bars 25 (which are attached on the circular iron plate 24 and iron ring 24' with the south poles facing the center point). The magnetic field strength suitably ranges from 700–900 Gauss. The whole electrode (anode) 13 is then supported by ceramic materials 26. As will be apparent to one skilled in the art, the anode configuration, as well as the materials of construction, can be varied. For instance, the titanium plate 23 or aluminum plate 22 could be made of other paramagnetic materials with low sputtering yields and the circular iron plate 24' or iron ring 24 could be made of other ferromagnetic materials.

To prepare for the plasma pretreatment and plasma deposition steps, the steel substrate is suspended at the center between two parallel anodes 13 and the steel substrate is connected to the negative pole of DC power supply 14 so that the steel substrate becomes cathode 12. In a commercial system, it would also be possible to mount anodes on robotic arms in order to cover complicated shapes, and the number, size and shape of the anodes and their positioning would change according to the desired use. The vacuum pump 17 is then used to evacuate the vacuum chamber 11 until the system pressure is lower than 1 millitorr. The system pressure is lower than 1 millitorr. The system pressure is controlled, independent of the gas flow rate, by throttle valve 18, using the reading of pressure gauge 19. The pretreatment gas or gases are fed into the vacuum chamber 11 at the desired flow rate, keeping the pressure below 1 torr, preferably less than 100 millitorr. The pretreatment gas is a means of removing oxygen and oxides from the surface of the metal by subjecting the metal suface to a reducing environment. The prefered embodiment comprises a mixture of hydrogen and argon.

An operating parameter for a low temperature plasma process can be given by the energy input level per mass of plasma gas, W/FM, given by joule/kg, where W is electric power input (W=joule/second) into the system, F is the molar flow rate, and M is the molecular weight of gas. (FM represents the mass flow rate.) According to this relationship, the flow rate to be employed is dependent on the power input and the molecular weight of the gas. This energy input per mass should be between 1 Megajoule per Kilogram and 500 Gigajoules per Kilogram.

The pretreatment plasma gas is fed through plasma gas feeding line 15 and the rate is controlled by using the appropriate plasma gas flow controller 16. Then power supply 14 is turned on to initiate the plasma state, and the power is then adjusted to the desired power level. The power level varies depending on flow rate, size of substrate, distance from cathode to anode, molecular weight of the pretreatment gas, pressure and so forth. The pretreatment plasma should be maintained for a desired period of time (typically from 30 seconds to 20 minutes), and then the power supply 14 should be turned off and the pretreatment gas flow should be stopped using the appropriate plasma gas shut off valve 20. The treatment time depends on the operating parameter W/FM. Efficient treatment can be obtained by maintaining the "(energy input) multiplied by (treatment time) divided by (mass)" at between 0.5 GigaJoule-Second per Kilogram and $3\times10^4$ GigaJoule-Sec per Kilogram. After the pretreatment plasma step, the vacuum chamber 11 should once again by evacuated using vacuum pump 17 to a pressure of below 1 millitorr. It would be possible to use either AC power or radio frequency (RF) power, rather than DC power, for the plasma pretreatment step.

Step 2: Plasma Polymer Deposition

Subsequent to the above described plasma treatment step, cathodic plasma deposition onto the metal substrate occurs. The basics of plasma deposition are described in Yasuda, *Plasma Polymerization*, published by Academic Press in 1985. Referring again to FIG. 1, plasma deposition may be accomplished by feeding a deposition gas into the vacuum chamber 11 through the plasma gas flow controller 16 at a desired flow rate. As in the case with the pretreatment plasma, the flow rate is dependent upon the power into the system and the molecular weight of the plasma gas. This energy input per mass should be between 10 MegaJoule per Kilogram and 1 Gigajoule per Kilogram depending upon the particular plasma deposition gas and the power level used. While feeding the plasma deposition gas into the vacuum chamber 11, it is important to keep the system pressure in the range of 1 millitorr to 1 torr, preferably 10 millitorr to 500 millitorr, and most preferably 20 millitorr to 100 millitorr. As discussed above, the system pressure is controlled, independent of the gas flow rate, by the throttle valve 18 which uses the reading from the pressure gauge 19.

Once the desired flow rate and system pressure is obtained, the power is turned on and adjusted to the desired power level. This power level varies dependent on flow rate, size of substrate, distance from cathode to anode, molecular weight of the plasma gas, pressure, and so forth. The plasma deposition should continue for a desired period of time in order to obtain the desired film properties and thickness. The film thickness can suitably range from 10 Angstroms to 10 micrometers, preferably 10 Angstroms to 5,000 Angstroms, and most preferably 10 Angstroms to 3,000 Angstroms. The deposition time is typically from 1 second to 20 minutes, preferably 30 seconds to 10 minutes, and most preferably 30 seconds to 2 minutes. Control of the deposition process may also be based upon the "(energy input) multiplied by (deposition time) divided by (mass)". This parameter should be kept between 0.5 GigaJoule-Second per Kilogram and 500 GigaJoule-Sec per Kilogram. After the desired period of time, the power supply 14 is turned off and the plasma gas flow should be stopped using the appropriate plasma gas shut-off valve 20. The deposition time depends on the power input level divided by mass expressed in Joule per Kilogram. Deposition that is efficient for corrosion resistance is dependent on film adhesion, film barrier properties and film thickness.

Suitable plasma deposition gases are organic compounds which include, but are not limited to, trimethylsilane, dimethylsilane (DMS), tetramethylsilane, or other organosilanes. Also suitable is methane with or without vinyl unsaturation. Other suitable organic compounds are organometallics known in the art of plasma deposition. The afore-mentioned gases are non-oxygen containing. It is necessary to deposit an oxygen-free plasma polymer. Some oxygen-containing gases may be counterproductive to the reducing effect of the plasma pretreatment. Reoxidation of the surface of the metal should be avoided.

In this way, the plasma polymer has good adhesion to the metal surface and has good compatibility to a cathodic E-coat primer under the conditions of cathodic E-coat application. Without this protective layer, the once reduced metal surface would be re-oxidized immediately as soon as the surface were exposed to atmospheric conditions, and any existing reducible compound such as metal oxides would be reduced during the E-coat application and yield a weak boundary layer at the E-coat/substrate interface.

It may be advantageous to use a carrier gas for the plasma deposition gas, especially if the vapor of a high boiling compound is used. The carrier gas can be inert gases such as argon and helium or reactive gases such as hydrogen and nitrogen or mixtures thereof.

Optimal protective coating in the recessed areas and good "throwing power" in a box-shaped cavity panel generally occurs when $L/D<5$, where L is the longitudinal length of the object and D is the average diameter of the cavity opening. For recessed areas with an L/D substantially greater than 5, pulsed systems may improve the results.

After conclusion of the deposition step, vacuum chamber 11 should be evacuated using vacuum pump 17 to a pressure of below 1 millitorr. This typically concludes the deposition step. It should be pointed out, however, that further layers of plasma film may be deposited on top of the first layer.

Step 3: Application of the Primer

After the cathodic plasma deposition, a primer coating is applied by electrodeposition. The application of an organic primer, by cathodic electrocoating, is necessary to a achieve the best corrosion protection. Any of a number of different primers well known in the art may be used. Examples include, but are not restricted to epoxy-amine, epoxy polyester-melamine, and others.

The primer formula may or may not contain catalysts (or accelerators), such as dialkyl tin oxide compounds, $H_2O$, acids, bases, organotitanates or organozirconates, and other organometallics.

The primer thickness can vary widely. Primer films of 2.5 microns to 125 microns thick can be coated on a metal substrate, but a preferred thickness range is 10 to 50 microns.

After deposition of the primer, subsequent topcoats may also be applied. These include primer surfacers, monocoats, and basecoat/clearcoat systems.

EXAMPLES

All of the examples, unless otherwise noted, were run as generally described in the Detailed Description Section infra. More specific information concerning the Examples are set out below:

(1) Steel substrate: size (4"×6"×0.032") which has been precleaned with solvent if it was oiled.

(2) Vacuum chamber: Pyrex® bell-jar of 18" diameter and 30" height.

(3) Power Source: External DC power supply (available from Advanced Energy Industries, Inc. as model MDX-1K)

(4) Electrode Description: The cathode is the steel substrate described above positioned between two anodes as shown in FIG. 2. Each anode is composed of an aluminum plate 23 (7"×7"×½"), a titanium plate 21 (7"×7"×1/16") which is attached on the inner side of the aluminum plate 23, an iron ring 24 (7" outer diameter, 5.5" inner diameter, 1/16" thick) which are attached on the backside of aluminum plate 23, 8 pieces of permanent magnetic bars 25 (3"×½"×¼") which are attached on the iron plate 24, and iron ring 24' with the south poles facing the center point. The magnetic field strength ranges from 700–800 gauss. The whole electrode (anode) 13 is then supported by ceramic materials 26. The cathode is positioned between the two parallel anodes with the titanium side facing the cathode at a distance of 2".

(5) Vacuum Pumping Mechanism: A mechanical booster pump (available from Shimadzu Corporation as model MB-100F) in series with a mechanical rotary pump (available from Sargent-Welch Scientific Company as model 1376).

(6) Pressure gauge: A capacitance barometer (available from MKS Instruments as model 220BA).

(7) Throttle valve (available from MKS Instruments as model 253A) and throttle valve controller (also available from MKS Instruments as model 252A).

(8) Flow controllers: Mass flow controllers (available from MKS Instruments as model 1259B).

The examples below involved a corrosion resistance test (scab test), in which test panels are scribed to expose the steel to the testing environments. The scribe line is at the center of the panel and is about 3 inches long. These scribed panels are then subjected to the following testing environments:

Monday through Friday:
15 minute immersion in 5% NaCl solution.
75 minute drying in air at room temperature.
22 hour and 30 minute exposure at 85% R.H. (relative humidity) and 60° C. environment.
Saturday and Sunday:
Samples remain in humidity cabinet (85% R.H., 60° C.).

Samples were examined occasionally. After completion of the scab corrosion test, the test panels were removed from the chamber and rinsed with warm water. The samples were examined visually for failure such as corrosion, lifting, peeling, adhesion loss, or blistering. To evaluate the scribe line corrosion creepback (loss of adhesion between primer and steel), the distance between the scribe line and the unaffected primer is measured. The average of multiple measurements is calculated.

COMPARATIVE EXAMPLE 1

This comparative example illustrates a process consisting of pretreatment of cold-rolled steel with a plasma gas consisting of an argon and hydrogen mixture, followed by plasma deposition of trimethylsilane in a mixture with hydrogen. However, no electrocoated primer was applied.

The substrate was a cleaned cold-rolled steel coupon (Available from ACT Corp., as product designation GM-92A). The $Ar/H_2$ plasma pretreatment conditions were as follows: DC power was 60 watts and voltage was 800–1200 V; energy input per mass was 1.68 giga-Joules per kilogram; Ar flow rate was 1 standard cubic centimeter per minute (sccm); $H_2$ flow rate was 4 sccm; system pressure was 50 millitorr; and power duration was 8 min.

Following pretreatment, the deposition of a thin film polymer employing a plasma of trimethylsilane (TMS) and $H_2$ mixture was carried out with the following conditions: DC power was 40 watts and voltage was 1200–1500 V; energy input per mass was 350 megajoules per Kilogram; TMS vapor flow rate was 2.0 sccm and $H_2$ gas flow rate was 4.0 sccm; system pressure was 50 millitorr; and power duration was 2 minutes. The sample was then subjected to humidity exposure under conditions of 85% R.H. and 60° C. for 3 days. The results are shown in Table 1 below.

COMPARATIVE EXAMPLE 2

This comparative example illustrates a process consisting of plasma pretreatment of cold-rolled steel, employing an argon and hydrogen mixture, followed by cathodic electrodeposition. However, there was no plasma deposition of a thin polymer film prior to electrodeposition of a primer.

The substrate was a cleaned cold-rolled steel coupon (Available from ACT Corp., as product designation GM-92A). The $Ar/H_2$ plasma pretreatment conditions were as follows: DC power was 60 watts and voltage was 800–1200 V; energy input per mass was 1.68 gigaJoules per kilogram; Ar flow rate was 1 standard cubic centimeter per minute (sccm); $H_2$ flow rate was 4 sccm; system pressure was 50 millitorr; and power duration was 8 min.

Following pretreatment, the plasma-treated substrate was then subjected to electrodeposition of a cathodic epoxy amine resin. The cathodic electrodepositable coating was prepared by using 4 parts (volume) of E5625 TM resin, 1 part (volume) of E5605 TM pigment paste, and 4 parts (volume) of deionized water. (The resin and pigment are commercially available from PPG Co., Pittsburgh, Pa.). The cathodic electrodeposition was carried out at 250 volts for a time period of two minutes. The electrodeposited film was then baked at 325° F. for 30 minutes. The film thickness was 25 microns.

The sample was then subjected to the corrosion test described above for 2 weeks. Neither the adhesion nor the corrosion protection of the above described system over bare steel is comparable to current commercially available electrocoat primers on zinc phosphated steel (control no. 1), but is better than that of the substrate without plasma treatment (control no. 2). The comparative results are shown in table 1 below.

COMPARATIVE EXAMPLE 3

This comparative example illustrates a process consisting of plasma deposition of trimethylsilane polymer on cold-rolled steel, followed by application of a primer by cathodic electrodeposition. However, there was no plasma treatment with hydrogen or argon.

The substrate was a cleaned cold-rolled steel coupon, (available from ACT Corp., as product designation GM-92A). The substrate was subjected to plasma deposition of a thin film of trimethylsilane (TMS) in mixture with $H_2$. The DC power was 40 watts and voltage was 1200–1500 V; the energy input per mass was 350 megajoules per kilogram. The TMS vapor flow rate was 2.0 sccm and $H_2$ gas flow rate was 4.0 sccm; the system pressure was 50 millitorr; and the power duration was 2 minutes.

The plasma-treated substrate was then subjected to electrodeposition of a cathodic epoxy-amine resin. The cathodic electrodepositable coating was prepared using 4 parts (volume) of E5625 TM resin, 1 part (volume) of E5605 TM pigment paste, and 4 parts (volume) of deionized water. The cathodic electrodeposition took place at 250 volts for a time period of two minutes. The electrodeposited film was then baked at 325° F. for 30 minutes. The film thickness was about 25 microns. The coating showed poor adhesion to the steel substrate.

COMPARATIVE EXAMPLE 4

This comparative example illustrates a process consisting of pretreatment of cold-rolled steel by oxygen plasma, followed by in-situ plasma deposition of trimethylsilane, and finally application of a primer by cathodic electrodeposition.

The substrate was a cleaned cold-rolled steel coupon (available from ACT Corp., as product designation GM-92A). The oxygen plasma pretreatment conditions were as follows: the DC power was 12 watts and voltage was 600–800 V; the energy input per mass was 0.25 gigajoules per kilogram. The oxygen flow rate was 2 standard cubic centimeter per minute (sccm). The system pressure was 50 millitorr; and the power duration was 2 min.

Following pretreatment, the deposition of a thin film of trimethylsilane (TMS) and $H_2$ mixture was carried out under the following conditions: the DC power was 35 watts and the voltage was 800–1200 V; the energy input per mass was 420 megajoules per kilogram. The TMS vapor flow rate was 2.0 sccm; the system pressure was 50 millitorr; and the power duration was 2 minutes.

The plasma-treated substrate was then subjected to electrodeposition of a cathodic epoxy-amine resin. The cathodic electrodepositable coating was prepared using 4 parts (volume) of E5625 TM resin, 1 part (volume) of E5605 TM pigment paste, and 4 parts (volume) of deionized water. The cathodic electrodeposition took place at 250 volts for a time period of two minutes. The electrodeposited film was then baked at 325° F. for 30 minutes. The film thickness was about 25 microns.

The sample thus made was then subjected to the corrosion test described above for 2 weeks. The adhesion was good based on a tape test (ASTM D3359). The average creep distances were 1.5 millimeter or less, and there was no blistering. Very minor edge corrosion was observed. The results are shown in Table 1 below.

EXAMPLE 5

This example illustrates one embodiment of a process according to the present invention wherein cold-rolled steel is subjected to pretreatment with a plasma employing hydrogen, followed by in-situ plasma deposition of trimethylsilane mixed with hydrogen, and finally application of a primer by cathodic electrodeposition.

The substrate was a cleaned cold-rolled steel coupon, (available from ACT Corp., as product designation GM-92A). The $Ar/H_2$ plasma pretreatment conditions were as follows: the DC power was 20 watts and the voltage was 800–1200 V; the energy input per mass was 3.4 gigajoules per kilogram. The hydrogen flow rate was 4 standard cubic centimeter per minute (sccm); the system pressure was 50 millitorr; and the power duration was 12 min.

Following pretreatment, the deposition of a thin film of trimethylsilane (TMS) and $H_2$ mixture was carried out under the following conditions: DC power was 80 watts and the voltage was 1400–1800 V; the energy input per mass was 700 megajoules per kilogram. The TMS vapor flow rate was 2.0 sccm and the $H_2$ gas flow rate was 4.0 sccm; the system pressure was 50 millitorr; and the power duration was 2 minutes.

The plasma-treated substrate was then subjected to electrodeposition of a cathodic epoxy-amine resin. The cathodic electrodepositable coating was prepared using 4 parts (volume) of E5625 TM resin, 1 part (volume) of E5605 TM pigment paste, and 4 parts (volume) of deionized water. The cathodic electrodeposition took place at 250 volts for a time period of two minutes. The electrodeposited film was then baked at 325° F. for 30 minutes. The film thickness was about 25 microns.

The sample thus made was then subjected to the corrosion test described above for 4 weeks and 8 weeks. The adhesion was good based on a tape test (ASTM D3359). The average creep distances were 0.9 and 1.5 millimeter for 4 and 8 weeks, respectively. There was no blistering. and very minor edge corrosion was observed. The results are shown in Table 1 below.

EXAMPLE 6

This illustrates another embodiment of a process according to the present invention wherein cold-rolled steel is subjected to pretreatment with a plasma employing argon, followed by in-situ plasma deposition of trimethylsilane mixed with hydrogen, and finally application of a primer by cathodic electrodeposition.

The substrate was a cleaned cold-rolled steel coupon, (available from ACT Corp., as product designation GM-92A). The Ar plasma pretreatment conditions were as follows: the DC power was 60 watts and the voltage was 800–1200 V; the energy input per mass was 0.5 gigajoules per kilogram. The Ar flow rate was 4 standard cubic centimeter per minute (sccm); the system pressure was 50 millitorr; and the power duration was 6 min.

Following pretreatment, the deposition of a thin film of trimethylsilane (TMS) and $H_2$ mixture was carried out under the following conditions: DC power was 80 watts and voltage was 1400–1800 V; the energy input per mass was 700 megajoules per kilogram. The TMS vapor flow rate was 2.0 sccm and the $H_2$ gas flow rate was 4.0 sccm; the system pressure was 50 millitorr; and the power duration was 2 minutes.

The plasma-treated substrate was then subjected to electrodeposition of a cathodic epoxy-amine resin. The cathodic electrodepositable coating was prepared using 4 parts (volume) of E5625 TM resin, 1 part (volume) of E5605 TM pigment paste, and 4 parts (volume) of deionized water. The cathodic electrodeposition took place at 250 volts for a time period of two minutes. The electrodeposited film was then baked at 325° F. for 30 minutes. The film thickness was about 25 microns.

The sample thus made was then subjected to the corrosion test described above for 2 weeks. The adhesion was good based on a tape test (ASTM D3359). The average creep distance was 1.8 millimeter or less, and there was no blistering. Very minor edge corrosion was observed. The results are shown in Table 1 below.

EXAMPLE 7

This illustrates one embodiment of a process according to the present invention wherein cold-rolled steel is subjected to pretreatment with a plasma employing a gaseous mixture of argon and hydrogen, in a mole ratio of 1:1, followed by in-situ plasma deposition of trimethylsilane mixed with hydrogen, and finally application of a primer by cathodic electrodeposition.

The substrate was a cleaned cold-rolled steel coupon, (available from ACT Corp., as product designation GM-92A). The $Ar/H_2$ plasma pretreatment conditions were as follows: DC power was 60 watts and voltage was 800–1200 V; energy input per mass was 1.68 gigaJoules per kilogram; Ar flow rate was 1 standard cubic centimeter per minute (sccm); $H_2$ flow rate was 4 sccm; system pressure was 50 millitorr; and power duration was 6 min.

Following pretreatment, the deposition of a thin film of trimethylsilane (TMS) and $H_2$ mixture was carried out under the following conditions: DC power was 80 watts and voltage was 1400–1800 V; energy input per mass was 700 megajoules per kilogram; TMS vapor flow rate was 2.0 sccm and $H_2$ gas flow rate was 4.0 sccm; system pressure was 50 millitorr; and power duration was 2 minutes.

The plasma-treated substrate was then subjected to electrodeposition of a cathodic epoxy-amine resin, the cathodic electrodepositable coating was prepared using 4 parts (volume) of E5625 TM resin, 1 part (volume) of E5605 TM pigment paste, and 4 parts (volume) of deionized water. The cathodic electrodeposition took place at 250 volts for a time period of two minutes. The electrodeposited film was then baked at 325° F. for 30 minutes. The film thickness was about 25 microns.

The sample thus made was then subjected to the corrosion test described above for 4 weeks and again for 8 weeks. The adhesion was good based on a tape test (ASTM D3359). The average creep distances were 0.4 and 0.9 millimeter for the 4 and 8 weeks tests, respectively, and there was no blistering. Very minor edge corrosion was observed. The results are shown in Table 1 below.

EXAMPLE 8

This illustrates one embodiment of a process according to the present invention wherein cold-rolled steel is subjected to pretreatment with a plasma employing a gaseous mixture of argon and hydrogen, followed by in-situ plasma deposition of methylsilane mixed with hydrogen, a second plasma deposition, this time using trimethylsilane mixed with hydrogen, and finally application of a primer by cathodic electrodeposition.

The substrate was a cleaned cold-rolled steel coupon, (available from ACT Corp., as product designation GM-92A). The $Ar/H_2$ plasma pretreatment conditions were as follows: DC power was 60 watts and voltage was 800–1200 V; energy input per mass was 1.68 gigaJoules per kilogram; Ar flow rate was 1 standard cubic centimeter per minute (sccm); $H_2$ flow rate was 4 sccm; system pressure was 50 millitorr; and power duration was 6 min.

Following pretreatment, the deposition of a thin film of methylsilane (MS) in $H_2$ was carried out under the following conditions: DC power was 60 watts and voltage was 900–1400 V; energy input per mass was 1.10 gigajoules per kilogram; MS vapor flow rate was 0.5 sccm and $H_2$ gas flow rate was 4.0 sccm; system pressure was 50 millitorr; and power duration was 20 minutes.

Following the first deposition, deposition of a thin film polymer of trimethylsilane (TMS) in $H_2$ was carried out under the following conditions: DC power was 80 watts and voltage was 1400–1800 V; energy input per mass was 700 megajoules per kilogram; TMS vapor flow rate was 2.0 sccm and $H_2$ gas flow rate was 4.0 sccm; system pressure was 50 millitorr; and power duration was 2 minutes.

The plasma-treated substrate was then subjected to electrodeposition of a cathodic epoxy-amine resin. The cathodic electrodepositable coating was prepared using 4 parts (volume) of E5625 TM resin, 1 part (volume) of E5605 TM pigment paste, and 4 parts (volume) of deionized water. The cathodic electrodeposition took place at 250 volts for a time period of two minutes. The electrodeposited film was then baked at 325° F. for 30 minutes. The film thickness was about 25 microns.

The sample thus made was then subjected to the corrosion test described above for 4 weeks and again for 8 weeks. The adhesion was good based on a tape test (ASTM D3359). The average creep distance was 0.3 and 9.0 millimeter for 4 and 8 weeks, respectively, and there was no blistering. Very minor edge corrosion was observed. The results are shown in Table 1 below.

EXAMPLE 9

This example was carried out the same as described in Example 5 above, except that the substrate was a cleaned electrogalvanized steel coupon (available from ACT Corp., as product designation GM-92E, Elec. Zinc G70/70). Plasma pretreatment, deposition with TMS, and application of an epoxy-amine primer with cathodic electrodeposition was identical to Example 3. The sample thus made was then subjected to the corrosion test described above for 4 weeks. The adhesion was good based on a tape test (ASTM D3359). The average creep distance was 1.2 millimeter or less, and there was no blistering. Very minor edge corrosion was observed. As a control, a galvanized phosphatized sample was similarly tested. The results are shown in Table 1 below.

TABLE 1

| Example | Substrate* | Pretreatment Plasma Gas | Plasma** Deposition | Cathodic Electrocoat | Scribe Creep (Scab corr. test) |
|---|---|---|---|---|---|
| Comparative Example 1 | CRS | Hydrogen/ Argon | TMS | No | no corrosion in humidity for 3 days |
| Control for Ex. 1 | CRS | Phosphated | — | No | severe corrosion in humidity for 3 days |
| Comparative Example 2 | CRS | Hydrogen/ Argon | — | Yes | 2 mm (2 weeks) |
| Control 1 for Ex. 2 | CRS | Phosphated | — | Yes | 0.6 mm (2 weeks) |
| Control 2 Example 2 | CRS | — | — | Yes | 4 mm (2 weeks) |
| Comparative Example 3 | CRS | — | TMS/Hydrogen | Yes | Failed |
| Example 4 | CRS | Oxygen | TMS/Hydrogen | Yes | 1.5 mm (2 weeks) |
| Example 5 | CRS | Hydrogen | TMS/Hydrogen | Yes | 0.9 mm (4 weeks)<br>1.5 mm (8 weeks) |
| Example 6 | CRS | Argon | TMS/Hydrogen | Yes | 1.8 mm (2 weeks) |
| Example 7 | CRS | Hydrogen/ Argon | TMS/Hydrogen | Yes | 0.4 mm (4 weeks)<br>0.9 mm (8 weeks) |
| Example 8 | CRS | Hydrogen/ Argon | MS/TMS/Hydrogen | Yes | 0.3 mm (4 weeks)<br>0.9 mm (8 weeks) |
| Control for for Ex. 3–8 | EGS | Phosphated | — | Yes | 1.0 mm (4 weeks)<br>1.5 mm (8 weeks) |
| Example 9 | EGS | Hydrogen | TMS | Yes | 1.2 mm (4 weeks) |
| Control for Example 9 | EGS | — | — | Yes | Failed, Delamination |

*Substrate: CRS = cold-rolled steel, EGS = electrogalvanized steel
**TMS = trimethylsilane, MS = methylsilane

We claim:

1. A method of coating a metal substrate to provide corrosion protection, which method comprises the following steps:
   (a) pretreating the metal substrate with a gas plasma to reduce or remove surface oxides from the metal substrate;
   (b) forming an oxygen-free film on the pretreated metal substrate by means of plasma deposition, comprising polymerizing a non-oxygen containing organic compound, wherein the plasma deposition employs DC power and is carried out in a vacuum chamber enclosing a cathode and anode, and wherein the metal substrate is the cathode; and
   (c) applying a primer by cathodic electrocoating the primer over said oxygen-free film.

2. The method of claim 1, wherein said anode is magnetically enhanced in step (b).

3. The method of claim 1, where the plasma deposition of a film in step (b) employs a compound selected from the group consisting of methylsilane, trimethylsilane, dimethylsilane, tetramethylsilane, methane, and combinations thereof.

4. The method of claim 1, where the metal substrate being processed is non-galvanized cold-rolled or bare steel.

5. The method of claim 1, further comprising a step (d) in which a monocoat, basecoat, or basecoat/clearcoat finish is applied over the primer.

6. The method of claim 1, where the gas plasma used for pretreating the metal substrate in step (a) is selected from the group consisting of argon, hydrogen, nitrogen, krypton, helium, neon, xenon and mixtures thereof.

7. The method of claim 1, wherein the primer is an epoxy-amine or epoxy-polyester melamine containing composition.

8. A method of coating a non-galvanized metal substrate to provide corrosion protection, which method comprises the following steps:
   (a) pretreating the non-galvanized metal substrate with a gas plasma to substantially remove oxygen and oxides from the surface of the metal substrate;
   (b) forming an organic polymeric film on the pretreated non-galvanized metal substrate by means of plasma deposition, wherein the plasma deposition employs DC power and is carried out in a vacuum chamber enclosing a cathode and anode, and wherein the metal substrate is the cathode; and
   (c) applying a primer by cathodic electrocoating the primer over said organic polymeric film.

9. The method of claim 8, wherein the gas plasma removes essentially all of the oxygen and oxides from the surface of the metal substrate.

* * * * *